US005423704A

United States Patent [19]

Foo

[11] Patent Number: 5,423,704

[45] Date of Patent: Jun. 13, 1995

[54] METHOD OF PRODUCING A LOW-PRESSURE MERCURY VAPOUR DISCHARGE LAMP

[75] Inventor: Onn F. Foo, Singapore, Singapore

[73] Assignee: Mass Technology (H.K.) Ltd., Kowloon, Hong Kong

[21] Appl. No.: 89,331

[22] Filed: Jul. 12, 1993

[30] Foreign Application Priority Data

Apr. 27, 1993 [GB] United Kingdom ..... 9308694

[51] Int. Cl.[6] ..... H01J 9/26

[52] U.S. Cl. ..... 445/22; 445/26; 65/54; 65/56

[58] Field of Search ..... 445/22, 26; 65/54, 56

[56] References Cited

U.S. PATENT DOCUMENTS 4,324,447 4/1982 van der Wolf et al. ..... 445/26
4,530,710 7/1985 Dullea et al. ..... 445/26
4,648,850 3/1987 Lima et al. ..... 445/22
5,090,931 2/1992 Shiraishi ..... 445/22

FOREIGN PATENT DOCUMENTS 1-173542 7/1989 Japan ..... 445/26
1-173543 7/1989 Japan ..... 445/26

*Primary Examiner*—P. Austin Bradley
*Assistant Examiner*—Jeffrey T. Knapp
*Attorney, Agent, or Firm*—Beveridge, DeGrandi, Weilacher & Young

[57] ABSTRACT

A method of producing a low-pressure mercury vapour discharge lamp comprising two or more substantially parallel co-extending glass discharge tubes includes forming an inter-connecting joint between the tubes by heating the tubes to form blisters and causing the blisters to simultaneously fuse and break, thereby forming a joint between the tubes.

5 Claims, 2 Drawing Sheets

METHOD OF PRODUCING A LOW-PRESSURE MERCURY VAPOUR DISCHARGE LAMP

This invention relates to a method of producing a low-pressure mercury vapour discharge lamp. The invention may also be applicable to the production of other types of discharge lamps.

More particularly, the invention relates to a method of producing a low-pressure mercury vapour discharge lamp comprising two or more substantially parallel co-extending glass discharge tubes, the discharge spaces of two adjacent discharge tubes being inter-connected by a coupling tube extending transverse to the axes of the discharge tubes, such that during operation of the lamp, the discharge passes predominantly through the discharge tube, and in which method the discharge tubes are first coated on the inside with a luminescent layer and then closed at one end. Such a method is disclosed in German patent specification 858,105.

German patent specification 858,105 describes a method in which the above-mentioned lamps are produced by providing an aperture in the glass wall of the discharge tube prior to deposition of a luminescent layer, the connecting coupling tubes being sealed thereto after the application of the luminescent layer.

UK patent specification GB 2 048 562B recognises that this method has the drawback that during the process of coating the discharge tube wall with luminescent material, which is often done by means of a suspension, liquid material can easily flow out through the aperture so that it is difficult to realise a uniform coating on the wall. There is also the risk that fusion of the coupling tube to the discharge tube is made difficult by enclosure of luminescent material in the glass seal. This may cause stresses in the glass and the chance of fracture is considerable.

In an attempt to overcome these drawbacks, the above mentioned UK patent specification proposes that such lamps are produced by a method in which the inner wall of the discharge tube is first coated with a luminescent layer and then sealed at one end. Once a luminescent layer has been deposited on the inner wall, the tube is heated to form an aperture. The aperture is formed with an outwardly facing collar. This process is repeated with a second discharge tube and the tubes are then placed with their apertures opposite one another. The collars are then fused together by further heating to form a coupling tube.

Such a method has the drawback -that exhaust gas, particles and even oil contained in the fuel supply piping will be unavoidably introduced into the gas discharge tube from the apertures.

In addition, when the collars are heated with a naked flame and fused to form the coupling tube, the luminescent material becomes polluted. This heating of the collars also results in an uneven accumulation of glass at the joint which may cause stresses in the glass. The risk of fracture and leakage in the region of the connection is therefore considerable.

An object of the present invention is to provide a method of inter-connecting two discharge tubes in a low-pressure mercury vapour discharge lamp without polluting the luminescent material inside the discharge tubes and/or providing improvements in relation to one or more of the matters discussed above, or generally.

According to the invention there is provided a method of producing a low-pressure mercury vapour discharge lamp as claimed in the accompanying claims.

In an embodiment there is provided a method of producing a low-pressure mercury vapour discharge lamp comprising two or more substantially parallel co-extending glass discharge tubes, the discharge spaces of two adjacent discharge tubes being inter-connected by an inter-connecting joint extending transversely to the wall of those discharge tubes. During operation of the lamp the discharge passes through the greater part of the discharge tubes. In the method, the inner walls of the discharge tubes are first coated with a luminescent layer and sealed at one end. After the provision of the luminescent layer to the inner walls of the discharge tubes, the connection between the discharge tubes is formed by placing the discharge tubes adjacent to each other and heating at points opposite to one another so that blisters are formed naturally on the wall of the discharge tubes. By thereafter applying regulated pressurised gas to enlarge the blisters, and by thereafter heating the blisters and moving the discharge tubes close to each other so as to join them together, and by thereafter applying regulated pressurised gas from one or more directions which results in breakage of the blisters and formation of a joint simultaneously, and by thereafter pulling the discharge tubes to the right distance, the connection is formed between the discharge tubes.

In the embodiment, the blisters are formed on the walls of the discharge tubes by heating at the points on the discharge tubes opposite to one another, these points thereafter being enlarged by applying regulated pressurised gas, and thereafter being joined by moving the discharge tubes close together, and thereafter being broken by applying regulated pressurised gas in one or more directions inside the discharge tubes so that a connection between the discharge tubes is formed.

When using the above method the glass discharge tubes are joined by a simultaneous fusing and joining process and, as no aperture is formed, no pollutants such as exhaust gas, particles and oil contained in the fuel supply piping will be introduced into the discharge tubes to pollute the luminescent material inside.

In addition, as the forming process of the blisters is similar to the blowing process for manufacturing bottles and the pulling of the connected discharge tubes eliminates uneven glass accumulated at the joint between the discharge tubes, the method of the present invention results in lower internal stresses in the glass, and the risk of fracture and leakage in the region of the connection is greatly reduced.

Embodiments of the invention will now be described by way of example only, with reference to the accompanying illustrative drawings in which.

Figure 1:
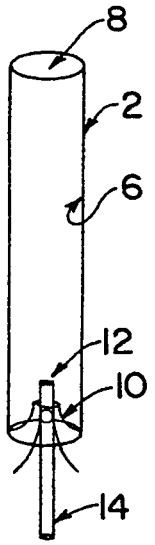
FIG. 1 shows a discharge tube of the type used to produce a low pressure mercury vapour discharge lamp according to the present invention.
Figure 2:
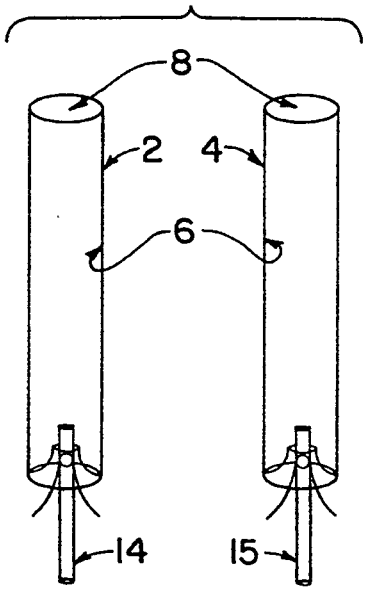
FIGS. 2 to 8 show the stages of a method according to an embodiment of the present invention.

A discharge lamp to be produced according to the method of the present invention comprises two glass discharge tubes 2 and 4, as shown in FIG. 1 and FIG. 2. Each tube 2 and 4 is coated with a luminescent layer 6.

The tubes 2 and 4 are sealed at one end 8. The inner surface of the sealed end 8 is also coated with a luminescent layer 6.

A stem 10 is located at the end of the tube 2 remote from the sealed end 8. An electrode 12 and an exhaust tube 14, 15 are connected to the stem 10.

As shown in FIG. 2, two discharge tubes of the type shown in FIG. 1 are placed adjacent each other so that they are parallel and co-extensive.

Figure 3:
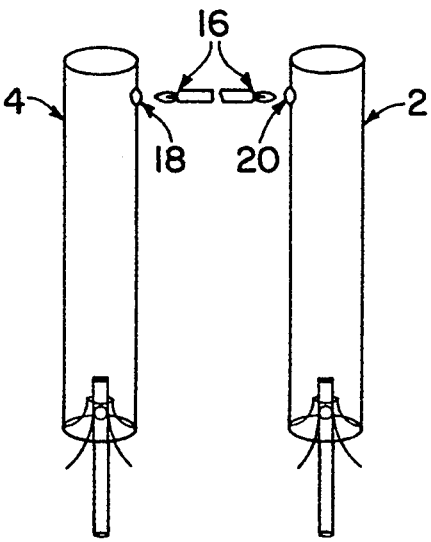

As shown in FIG. 3, heat 16 is applied simultaneously to opposite points on the side walls of the tubes 2 and 4, so that blisters 18 and 20 are naturally formed.

Figure 4:
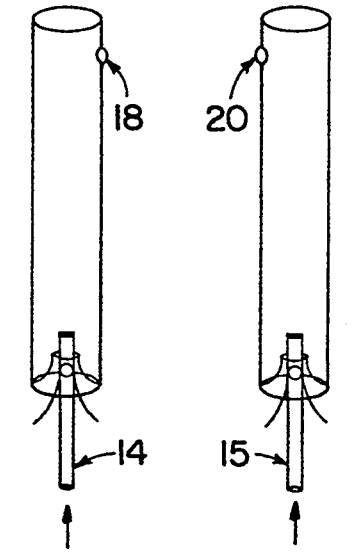

As shown in FIG. 4, gas is introduced through exhaust tubes 14 and 15, applying a regulated pressure which enlarges the blisters 18 and 20.

Figure 5:
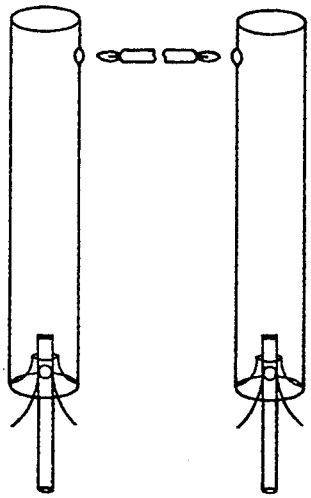

The blisters 18 and 20 are then subjected to further heating (FIG. 5) and thereafter the discharge tubes 2 and 4 are moved close to each other so as to join them together, as shown in FIG. 6.

Figure 6A:
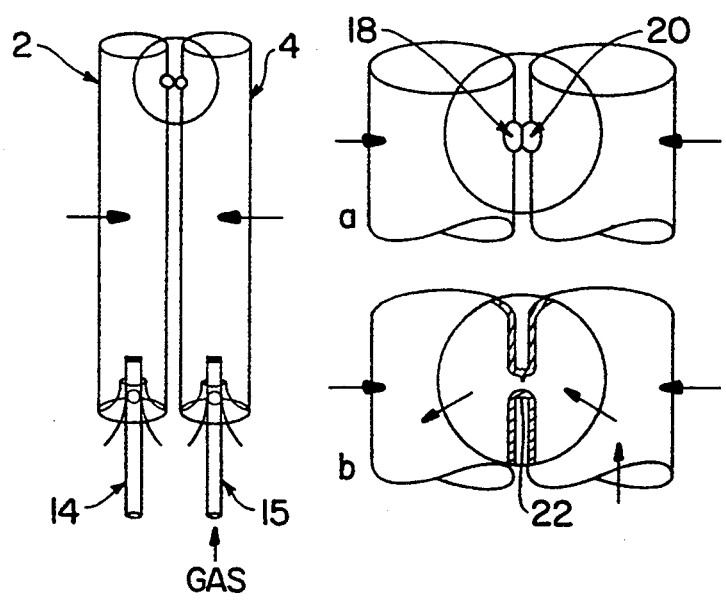
Figure 6B:
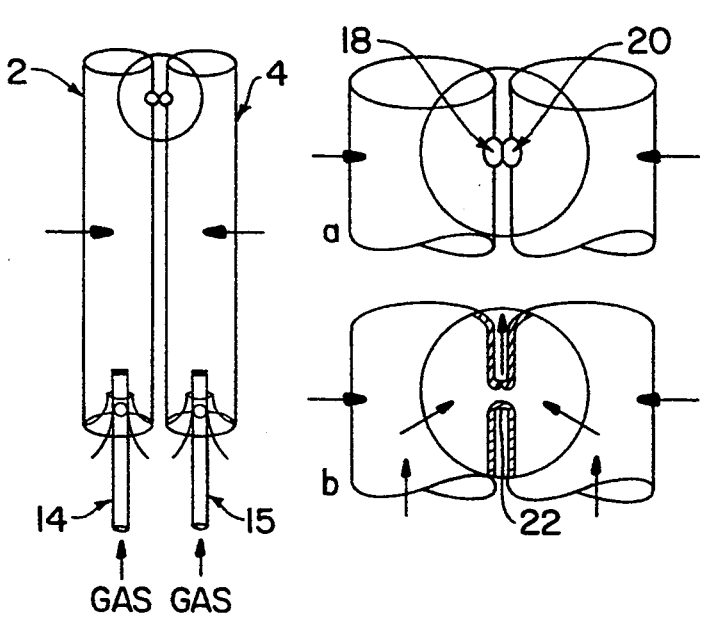

Pressurised gas is then introduced into the discharge tubes 2 and 4, either from one exhaust tube 14 (as shown in FIG. 6A) or through both exhaust tubes 14 and 15 (as shown in FIG. 6B). Application of the gas pressure to the blisters 18 and 20 results in their breakage and the simultaneous formation of a joint 22.

Figure 7:
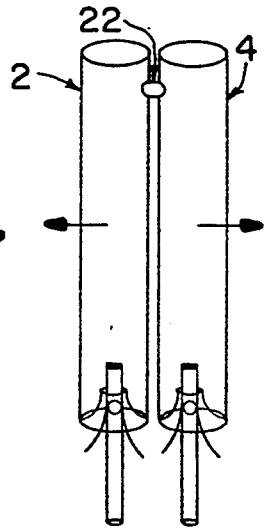
Figure 8:
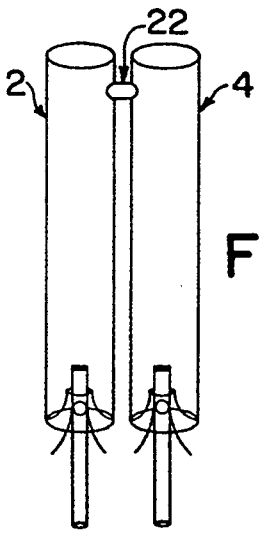

The discharge tubes 2 and 4 are pulled apart (as shown in FIG. 7) to the required separation, forming lamp 24, shown in FIG. 8. This step of pulling the connected tubes apart eliminates uneven glass accumulated at the joint between the discharge tubes, so reducing the internal stresses in the glass. Thus the risk of fracture and leakage in this region is greatly reduced.

I claim:

1. A method of producing a low-pressure mercury vapour discharge lamp including two or more substantially parallel co-extending glass discharge tubes having their discharge spaces inter-connected by an inter-connecting joint extending transversely between opposite walls of said discharge tubes, wherein during operation of the lamp a discharge passes through said discharge tubes, said method comprising:

coating the inner walls of each of the discharge tubes with a luminescent layer; thereafter, sealing each of the discharge tubes at one end; thereafter, placing said discharge tubes adjacent to each other and heating the walls of said tubes at points opposite to one another until blisters are formed on the heated walls of the discharge tubes; thereafter, applying regulated pressurised gas into each of said tubes to enlarge the heated blister formed thereon; thereafter, heating said blisters; thereafter, moving the discharge tubes toward each other until the heated blisters are in contact, thereafter supplying regulated pressurised gas into one or both discharge tubes to break said heated blisters and form a joint between said tubes; and, thereafter separating the discharge tubes a predetermined distance to stretch said formed inter-connection joint between said discharge tubes.

2. A method of producing a low-pressure mercury vapour discharge lamp comprising two or more substantially parallel co-extending glass discharge tubes having an inter-connecting hollow joint formed between the tubes, said method comprising:

coating inner walls of each of the discharge tubes with a luminescent layer; thereafter, heating an area on the wall of each tube to form a blister thereon; thereafter, positioning the tubes so as to make contact between the heated blisters; thereafter, supplying sufficient pressurized gas into one or both discharge tubes to cause each of the blisters to simultaneously break and fuse together, thereby forming a hollow joint between the tubes.

3. The method as claimed in claim 2, wherein after the steps of breaking and fusing together of the blisters to form a hollow joint between said tubes, further comprising the step of moving one of said tubes a predetermined distance from said other tube to pull and extend said heated joint whereby the length of said joint is increased.

4. The method as claimed in claim 2, wherein said area of the walls of each discharge tube being heated are opposite each other.

5. The method as claimed in claim 4, wherein after the steps of breaking and fusing together of the blisters to form a hollow joint between said tubes, further comprising the step of moving one of said tubes a predetermined distance from said other tube to pull and extend said heated joint whereby the length of said joint is increased.

* * * * *